US006991395B1

(12) United States Patent
Huang

(10) Patent No.: US 6,991,395 B1
(45) Date of Patent: Jan. 31, 2006

(54) INK CONTROL MECHANISM FOR A PEN

(76) Inventor: Tao-Tien Huang, No. 30, Lane 120, Chang-Lu Rd., Chang-Hua City (TW)

( * ) Notice: Subject to any disclaimer, the term of this patent is extended or adjusted under 35 U.S.C. 154(b) by 0 days.

(21) Appl. No.: 11/027,199

(22) Filed: Jan. 3, 2005

(51) Int. Cl.
*B43M 11/06* (2006.01)
*B43K 5/00* (2006.01)
*B05C 1/00* (2006.01)
*A47L 1/08* (2006.01)

(52) U.S. Cl. ..... 401/186; 401/205; 401/206; 401/17; 401/23

(58) Field of Classification Search ..... 401/186, 401/184, 185, 205, 206, 278, 279, 17, 18, 401/23
See application file for complete search history.

(56) References Cited

U.S. PATENT DOCUMENTS 3,196,886 A * 7/1965 Brown ..... 401/186
4,867,593 A * 9/1989 Kurokawa et al. ..... 401/186
6,332,730 B1 * 12/2001 Taghavi-Khanghah ..... 401/264
6,464,418 B1 * 10/2002 Visser et al. ..... 401/34

* cited by examiner

*Primary Examiner*—David J. Walczak
(74) *Attorney, Agent, or Firm*—Egbert Law Offices

(57) ABSTRACT

The ink control structure of a pen includes a pen body and a pen point. The interior of the pen body is an empty cavity for containing ink and the surrounding wall of the pen body is flexible and can be pinched. The inner end of the pen point joins the empty cavity via an ink supply passage. The pen point has hydraulic conductivity and can lead the ink out. The pressure-driven control valve is configured into the ink supply passage and includes a stopper end and an elastic part. The elastic part can normally push the stopper end to pressingly meet a narrow opening in the ink supply passage, thus forming a state that the ink is prevented from a flow out. While under pressure, the ink supply passage is opened to make ink flow downward to the pen point for applying or writing.

5 Claims, 9 Drawing Sheets

A-A sectional view

INK CONTROL MECHANISM FOR A PEN

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pen, and more particularly to a structurally and spatially innovative pen that has a pressure-driven control valve at the inner end of its pen point, which will block the ink supply passage under the push of the elastic part thereof, and the ink passage will then be opened when the pen body is pressed so as to let ink flow to the pen point.

BACKGROUND OF THE INVENTION

Generally, pens have different functions and types according to the difference of its interior ink such as nail painting pens, light extinction pens, marker pens and color pens etc., whose structures are equally characterized by pen points and empty pen bodies and the main difference comes from the ink set therein. About the ink currently available, their structures are generally divided into following two types.

Type 1, the inner end of its pen point is directly extended into the empty cavity in the pen body and the cavity is filled with liquid ink. Then the ink can be slowly let out by means of the hydraulic conductivity of the pen point itself and provided for applying or writing (e.g. nail painting pen). However, it is found from the conventional structure that, the interior ink, especially the volatile ink, can be exhausted continuously from a pen point, resulting in such defects as quick consumption, short lifespan and volumes of leakage of ink.

Type 2, the inner end of its pen point that is extended into the empty cavity in the pen body is inserted into a cotton strip that contains absorbed ink. Then the ink can be slowly let out by means of the hydraulic conductivity of the pen point itself and provided for applying or writing (e.g. marker pen). However, in practical application, it is found from the known structure that, due to a cotton strip's smaller ink absorption and content than that of aforesaid structure, and continuous exhaustion from the pen point, it possesses such disadvantages as quick consumption, short lifespan and the need of frequent supply or even rejection.

Accordingly, in order to solve the problems of the conventional pens when they are used, it would be desirable for the industry to provide a structure which is more practical.

Above all, the inventor elaborately designed and tested the pen structure on the basis of rich experience in product development and design, to thereby present the invention finally.

BRIEF SUMMARY OF THE INVENTION

The improvements brought about by this invention are as follows.

1. A structurally and spatially innovative pen that has a pressure-driven control valve at the inner end of its pen point is provided. The design is originated in the trade and meets the requirements of novelty of a new-pattern patent.

2. According to this specially improved structure, in usage of the pen, the object of ink supply can be reached by means of pinching the pen body; while in spare, the ink supply of the pen point will automatically be failed by the control valve to achieve the practical effect of preventing continuous ink volatilization, prolonging ink lifespan and avoiding volumes of ink leakage, which enable it to meet the requirements of novelty of a new-pattern patent.

The new effects that can be generated by using the invention are as follows.

1. Wherein the stopper end 41 and elastic part 42 can be of plastic-rubber extrusion molding type, thus being simple to make and easy for mass production.

2. The end of the pen where pen point 20 is arranged can be covered with a pen cap 50. When the pen cap 50 is in covering state, the user will fail to pinch the pen body 10 due to the failure of pressure release in the empty cavity 11, thus to prevent the ink from flowing out due to unintentional pressing of the pen body when the pen is not used.

However, though the preferred embodiments have been set forth in the foregoing description, the disclosure is illustrative only, but does not limit the present invention, and changes may be made in detail within the principles of the invention to the full extent indicated by the broad general meaning of the terms in which the appended claims are expressed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

As shown in FIGS. 1–4, there is a nail painting pen embodied in the present invention that provides enhanced ink control mechanism.

The present invention includes an empty pen body 10 with an empty cavity 11 internally to contain the supplied liquid ink (e.g. nail oil in the embodiment), and the surrounding wall of the pen body 10 is flexible and can be pinched and bring pressure to the empty cavity 11.

The invention also includes a pen point 20 configured at the end of pen body 10. The material and type of the pen point are of no limitation and can include currently popular fiber material or ballpoint pen point. The pen point 20 shall have hydraulic conductivity to lead the ink out.

There is an ink supply passage 30 used to join the inner end of pen point 20 and the empty cavity 11.

Figure 5:
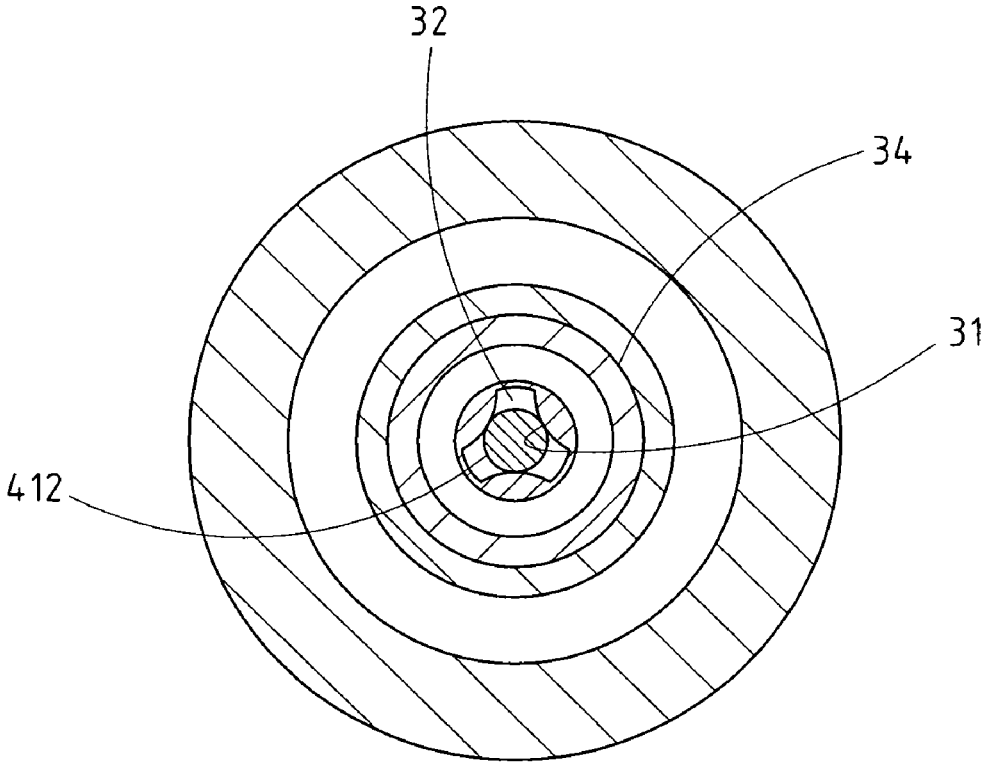
FIG. 5 shows another sectional view across line A—A of FIG. 4.

The invention further includes a pressure-driven control valve 40 which is configured into the ink supply passage 30 and comprises a stopper end 41 and an elastic part 42, wherein the stopper end 41 and elastic part 42 can be of plastic-rubber molding type; the stopper end 41 is a two-section step-type column comprising a large and a small step columns 411, 412; the elastic part 42 is then of a zigzag sheet shape; and a narrow opening 31 is provided in the ink supply passage 30 and will pressingly meet the stopper end 41 of the control valve 40, wherein the narrow opening 31 can be configured as a non-circular through-hole shape (e.g. the trifurcate narrow opening shown in FIG. 5) so as to fully close the narrow opening 31 when the large step column 411 of aforesaid stopper end 41 pressingly meet it; while in separation from the large step column 411, the ink W will flow away via the gap 32, and the small step column 412 is normally arranged in the narrow opening 31 to offer lubrication function.

In the aforesaid embodiment, the narrow opening 31 of ink supply passage 30 can be formed by means of arranging an inner block 33. The inner block 33 has a protruding pipe 34 that can be inserted into the ink supply passage 30 to form the narrow opening 31. In addition, the inside of inner block 33 can be designed as a brush hair end 35 to meet the demand of this nail painting pen.

Figure 4:
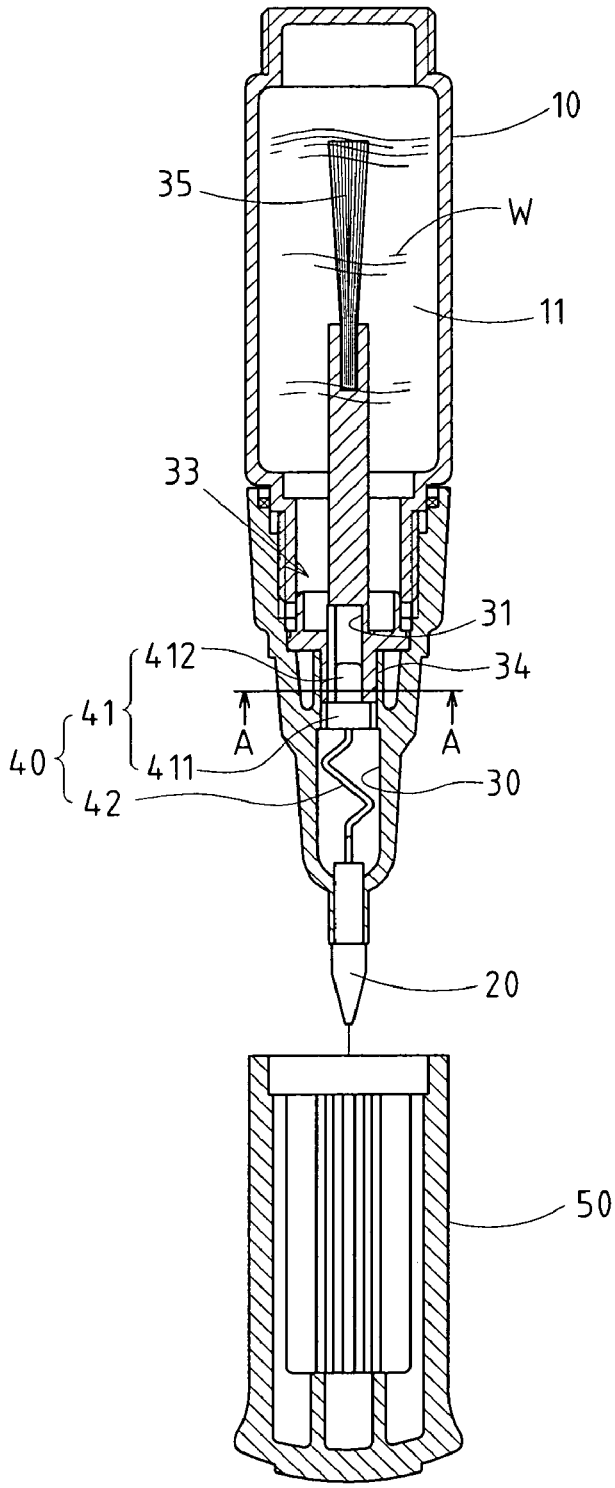
FIG. 4 shows an installed sectional view of the preferred embodiment of the present invention.
Figure 6:
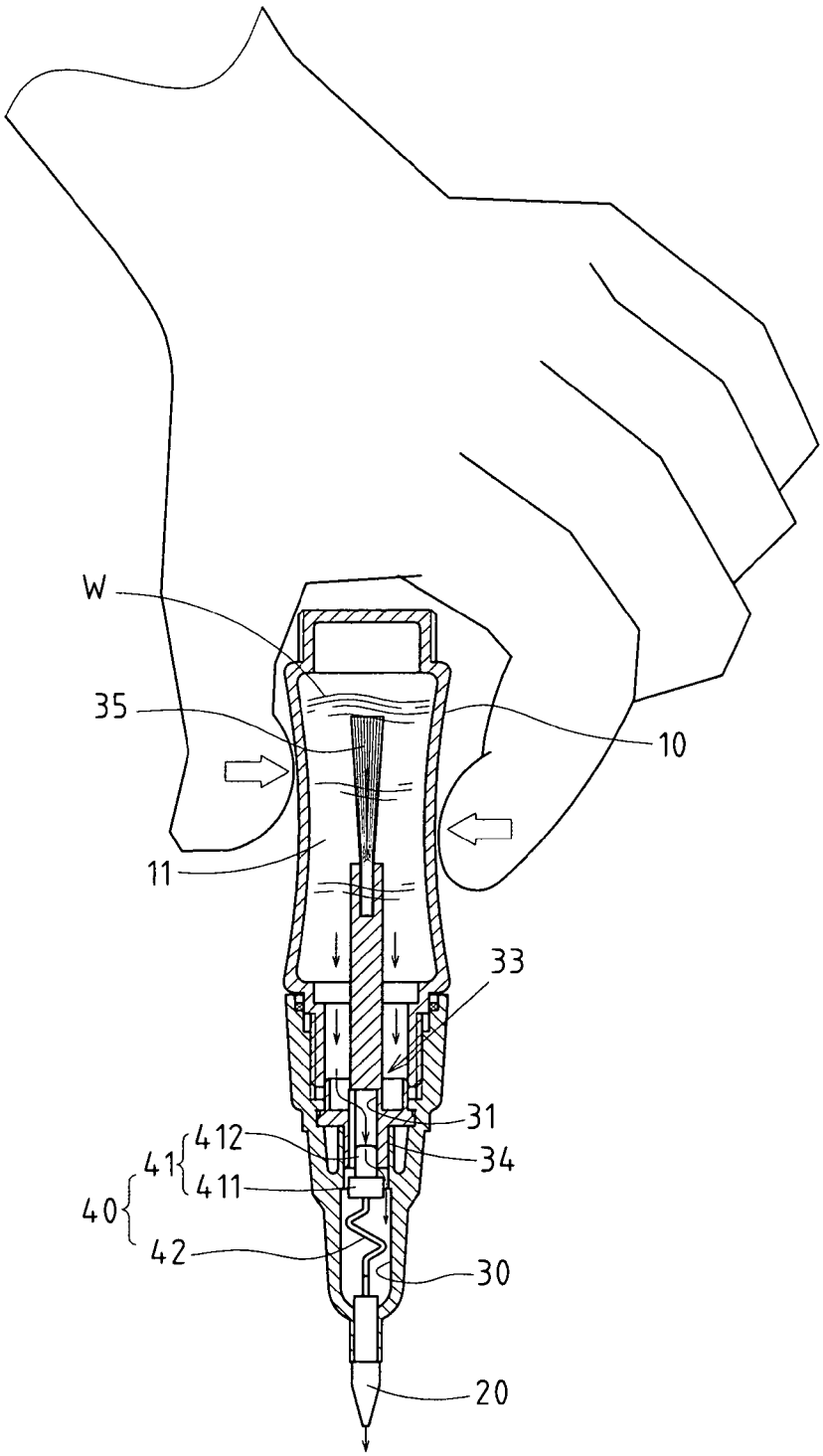
FIG. 6 shows a sectional view of an illustration of an exemplary operation of the present invention.

According to the design composed of aforesaid components, when the pen is not in use, as shown in FIG. 4, the elastic part 42 of the control valve 40 can normally push the stopper end 41 to pressingly meet the narrow opening 31 of ink supply passage 30 to form the state that the ink W in the empty cavity 11 is closed to prevent it from flowing out. While in using the pen, as shown in FIG. 6, the user can pinch the pen body 10 to bring pressure to the empty cavity 11, at this time, the interior pressure can be greater than the pressure of the elastic part 42 of the control valve 40, thus enable the stopper end 41 to separate from the narrow opening 31 downwards, and then the ink supply passage 30 can be opened so as to make ink W flow downward to the pen point 20 for applying or writing. Namely, in usage, the object of ink supply can be reached through pinching the pen body 10, while in spare, the ink supply of the pen point 20 will automatically be failed by the control valve 40 to achieve the practical effect of preventing continuous ink volatilization, prolonging ink lifespan and avoiding volumes of ink leakage.

Wherein, the end of the pen where pen point 20 is arranged can be covered with a pen cap 50. When the pen cap 50 is in covering state, the user will fail to pinch the pen body 10 due to the failure of pressure release in the empty cavity 11, thus to prevent the ink from flowing out due to unintentional pressing when the pen is not used.

Figure 1:
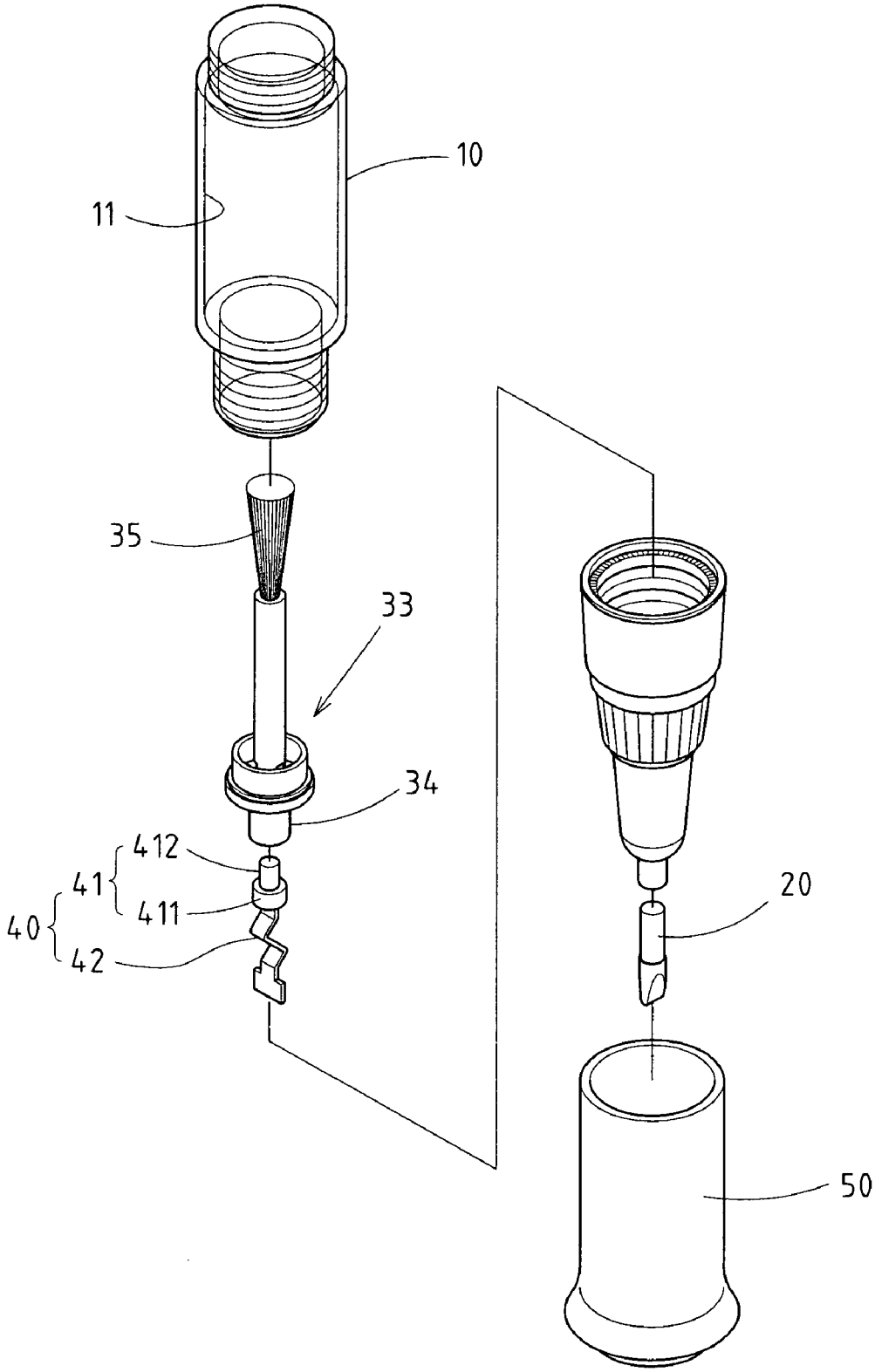
FIG. 1 shows an exploded perspective view of the preferred embodiment present invention.
Figure 2:
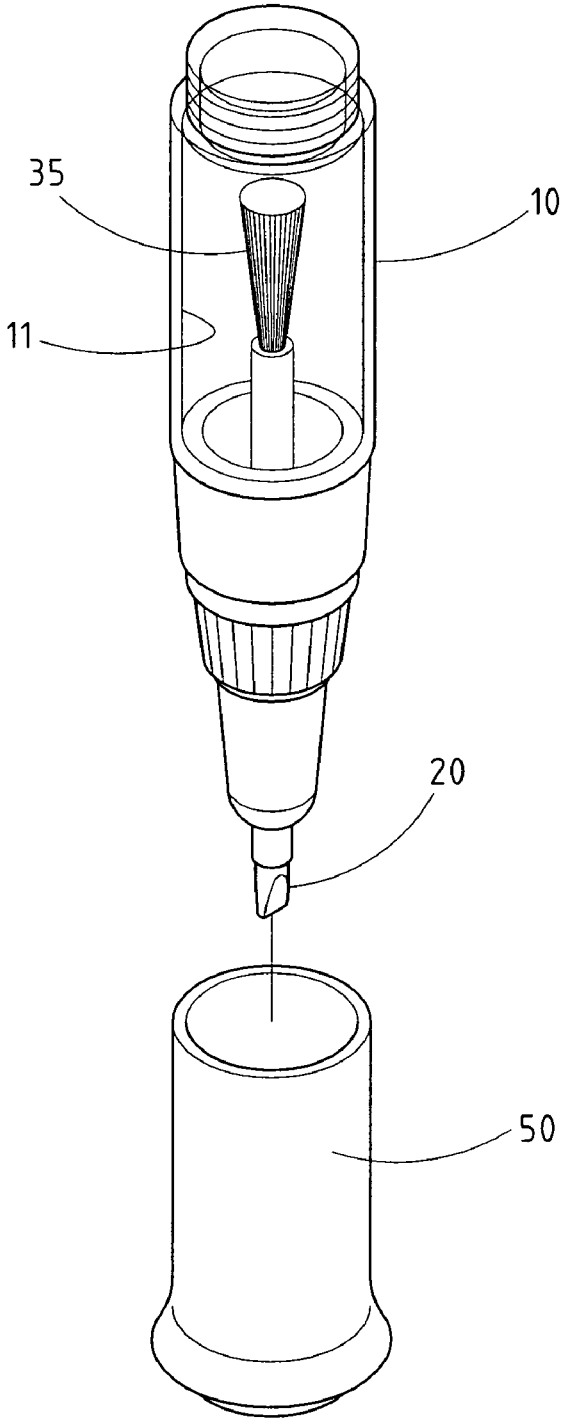
FIG. 2 shows an installed perspective view of the preferred embodiment of the present invention.
Figure 3:
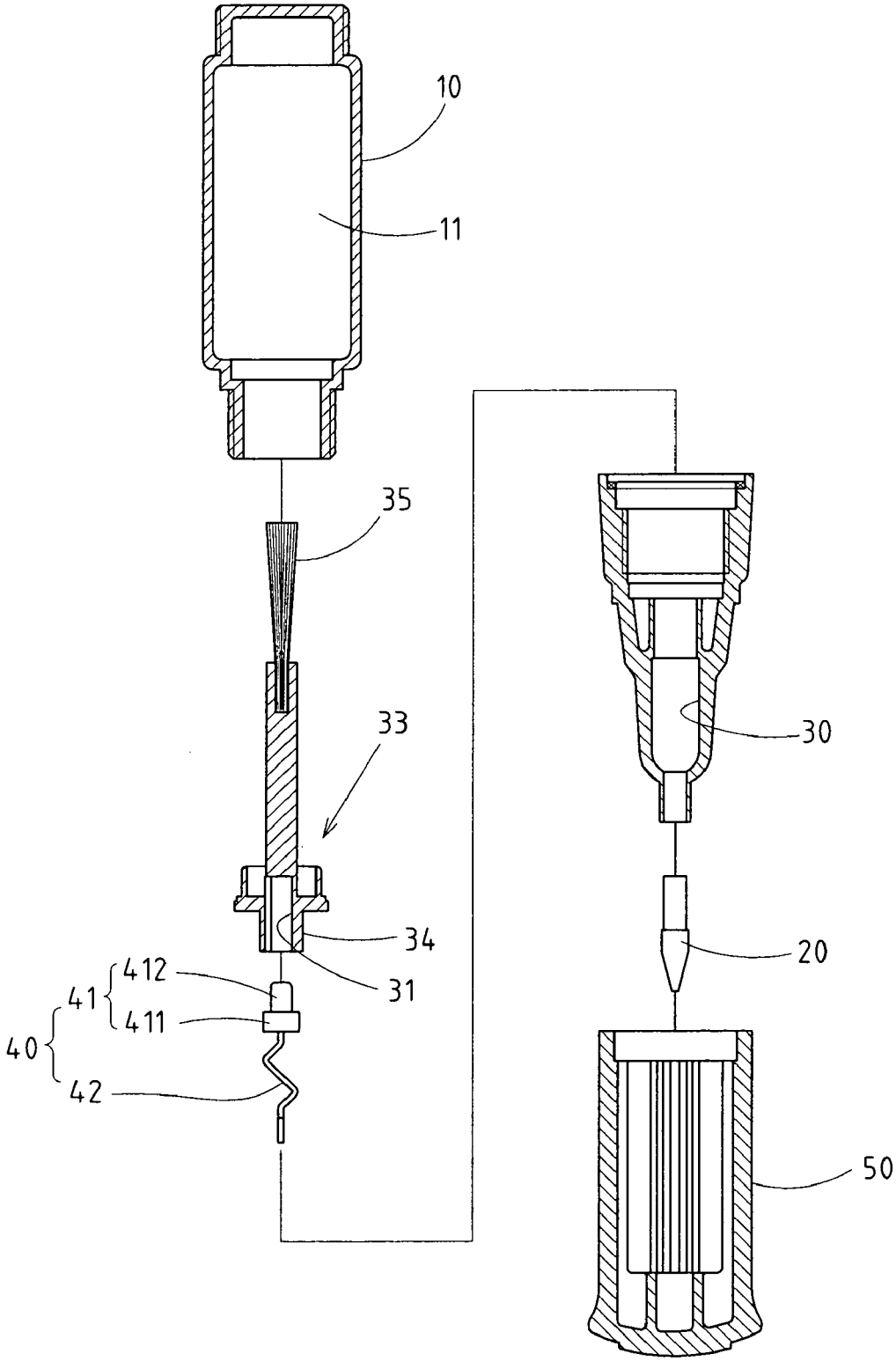
FIG. 3 shows an exploded sectional view of the preferred embodiment of the present invention.
Figure 7:
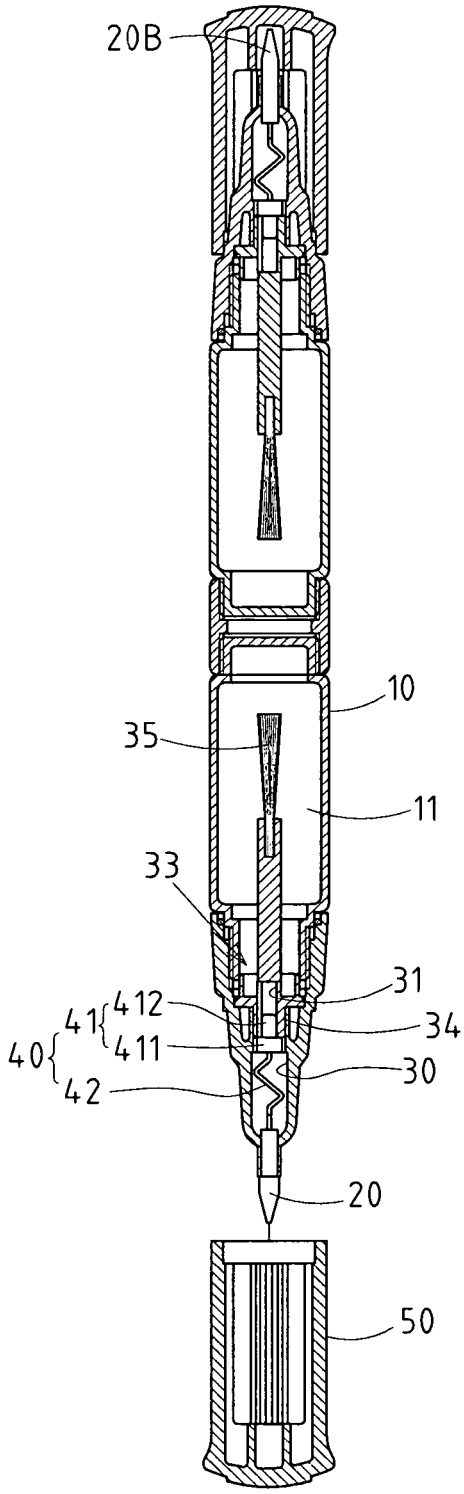
FIG. 7 shows another sectional view illustrating an example of double pen points.

Wherein, the pen disclosed in the invention can not only be the single pen point 20 structure (as shown in FIG. 1), but also be the structure having double pen points 20, 20B shown in FIG. 7 (nail painting pen as well).

Figure 8:
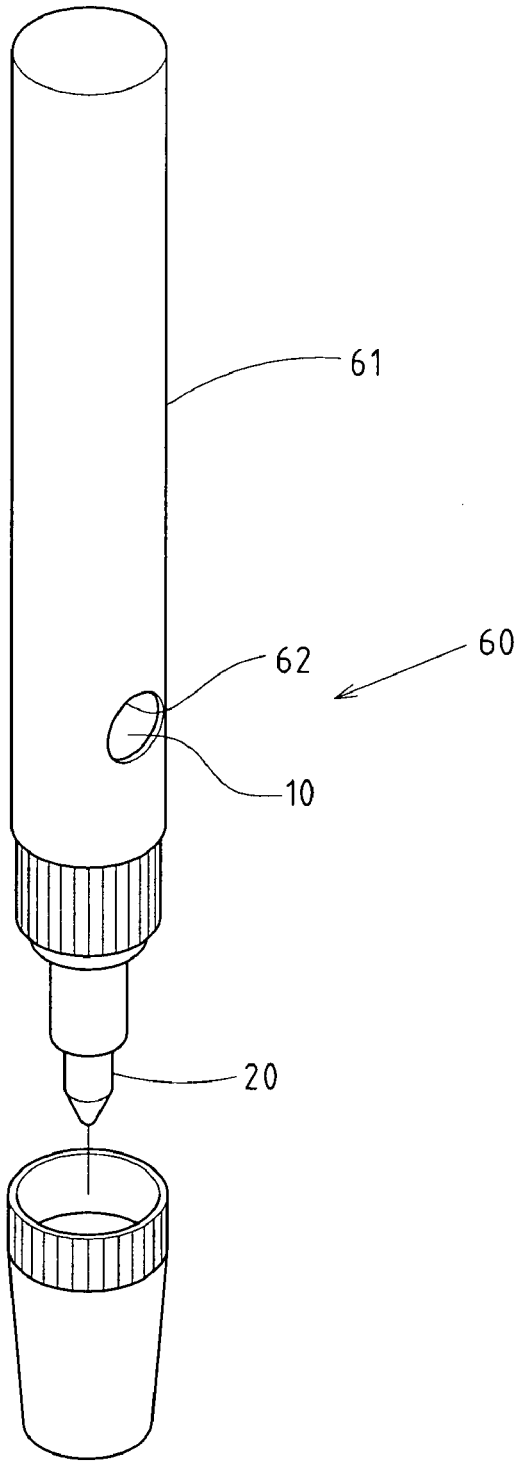
FIG. 8 shows another perspective view of the preferred embodiment of the present invention.
Figure 9:
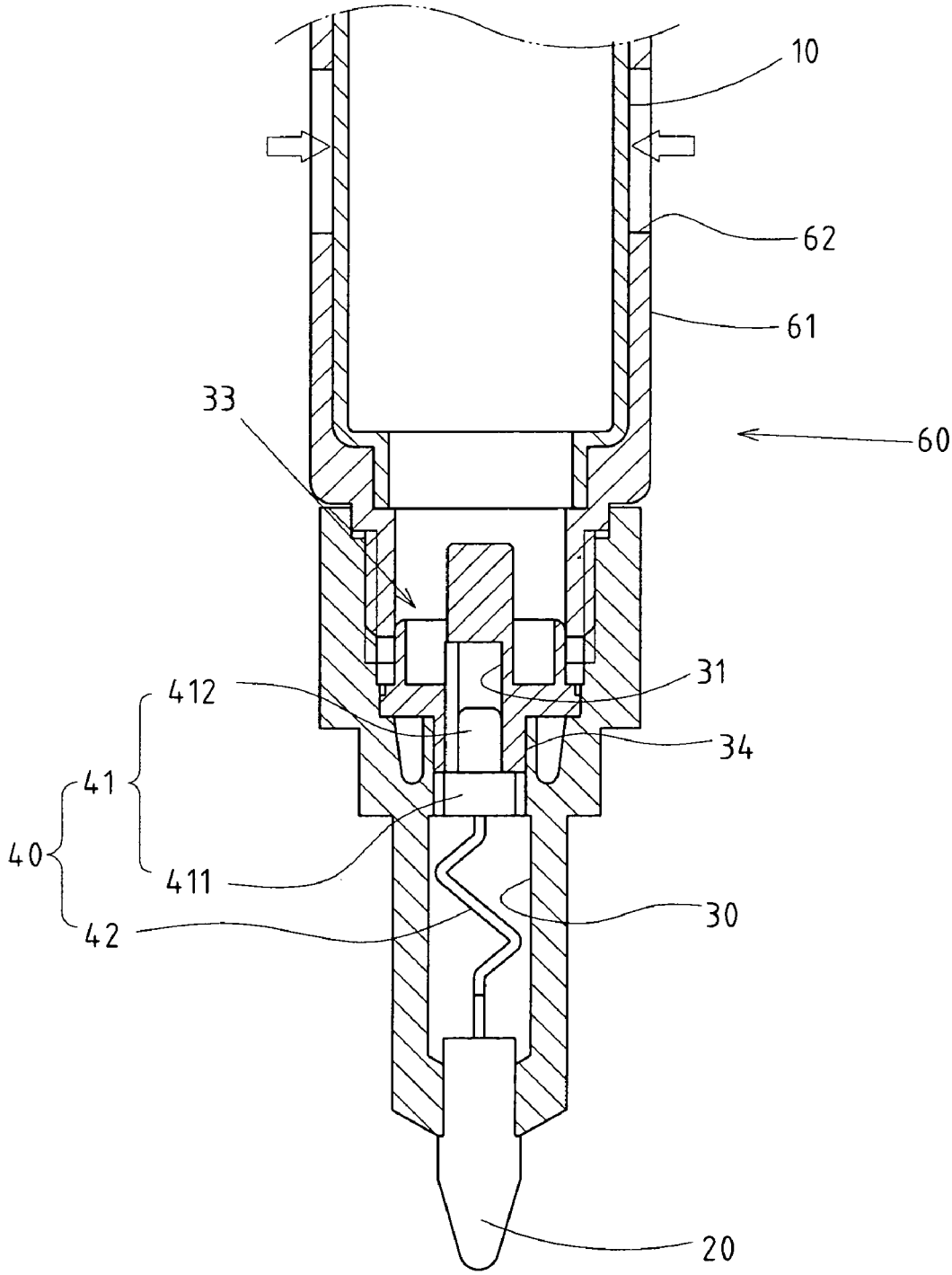
FIG. 9 shows a partial enlarged sectional view of the preferred embodiment of the present invention.

Then as shown in FIGS. 8 and 9, another preferred embodiment of the invented pen is disclosed. It is a marker pen 60 and its general structural composition is similar to the disclosure for preceding embodiment (referring to figure numbers), and then needs no redundant description. The only difference is that the pen body of the marker pen 60 can be a double layer design composed of inner and outer layers. The inner layer is the flexible pen body 10 that can be pinched, while the outer layer can be a rigid cylinder 61 that is common to a marker pen, and a through-hole 62 is set at an appropriate place of the rigid cylinder 61 to let human's finger access to press the internal flexible pen body 10 (shown as arrow in FIG. 9).

I claim:

1. A pen with an improved ink control mechanism comprising:

a pen body with an empty cavity internal thereof, said cavity suitable for containing supplied ink, said pen body having a wall surrounding said cavity, said wall being flexible and suitable for being pinched so as to apply pressure to said cavity;

a pen point affixed to an end of said pen body, said pen point being hydraulically conductive so as to deliver ink therefrom;

an ink supply passage joining an inner end of said pen point to said cavity; and a pressure-driven control valve comprising a stopper end and an elastic part, said elastic part pushing said stopper end so as to meet a narrow opening in said ink supply passage so as to prevent ink from flowing outwardly therefrom, said stopper end separate from said narrow opening when said pen body has pressure applied thereto so as to allow ink to flow downwardly from said ink supply passage to said pen point, said stopper end is a two-section step-type column, said elastic part being of a zigzag sheet shape.

2. The pen of claim 1, said stopper end and said elastic part being of a plastic-rubber molded material.

3. The pen of claim 1, said narrow opening of said ink supply passage comprising an inner block with a protruding pipe, said pipe inserted into said ink supply passage so as to form said narrow opening.

4. The pen of claim 1, further comprising;

a pen cap covering said pen point and a portion of said end of said pen body.

5. The pen of claim 1, said pen point comprising a double pen point.

* * * * *